US005613839A

United States Patent [19]

Buckley

[11] Patent Number: 5,613,839

[45] Date of Patent: Mar. 25, 1997

[54] VARIABLE RATE PUMP

[75] Inventor: Paul Buckley, Rainham, United Kingdom

[73] Assignee: Lucas Industries Public Limited Company, Solihull, England

[21] Appl. No.: 458,587

[22] Filed: Jun. 2, 1995

[30] Foreign Application Priority Data

Jun. 2, 1994 [GB] United Kingdom ..... 9411054

[51] Int. Cl.[6] ..... F04B 1/04

[52] U.S. Cl. ..... 417/273; 417/462; 417/487; 417/492; 417/498; 123/450

[58] Field of Search ..... 417/273, 462, 417/487, 492, 498, 500; 123/450, 179.17, 496

[56] References Cited

U.S. PATENT DOCUMENTS

| | | | |
|---|---|---|---|
| 3,046,905 | 7/1962 | Davis | 103/161 |
| 3,936,233 | 2/1976 | Bonin | 417/214 |
| 4,564,341 | 1/1986 | Tanaka | 417/462 |
| 5,345,916 | 9/1994 | Amann et al. | 123/496 |
| 5,425,341 | 6/1995 | Connolly et al. | 123/450 |

FOREIGN PATENT DOCUMENTS 1577952 10/1980 United Kingdom .

*Primary Examiner*—Charles G. Freay
*Attorney, Agent, or Firm*—Jacobson, Price, Holman & Stern, PLLC

[57] ABSTRACT

A variable rate pump including a distributor member rotatable within a sleeve. The distributor member is provided with a bore within which a pumping plunger is reciprocable under the influence of a first cam lobe and a second cam lobe. A valve is provided for selecting whether fuel is supplied due to the motion of the plunger under the influence of the first cam lobe or the second cam lobe. An arrangement is also provided in which the distributor member carries first and second plungers each reciprocable under the influence of respective cam lobes. A valve is provided for selecting whether the fuel is supplied by the first plunger or by the second plunger.

15 Claims, 4 Drawing Sheets

VARIABLE RATE PUMP

This invention relates to a variable rate pump and in particular to a variable rate rotary fuel pump for use in a compression ignition engine.

Rotary fuel pumps commonly comprise a distributor member rotatable within a sleeve, an enlarged portion of the distributor member being provided with at least one bore within which a plunger member is slidable. The enlarged portion rotates within a cam ring including a plurality of cam lobes each having a leading flank and a trailing flank, the outer end of the or each plunger member being provided with a cam follower comprising a shoe housing a roller arranged to engage with the cam ring. The distributor member includes a delivery passage arranged to communicate with an outlet port provided in the sleeve at a predetermined orientation of the distributor member with respect to the sleeve. The distributor member further includes at least one inlet passage arranged to communicate with an inlet port provided in the sleeve, the delivery passage and inlet passage communicating with one another and with the or each bore.

The pump is arranged so that, in use, the distributor member is driven in timed relationship with an associated engine. As the distributor member rotates, the plungers are urged into the bores as the associated rollers engage the leading flanks of the lobes, and can move outwardly when the associated rollers are under the control of the trailing flanks of the cam lobes. During use of the pump, fuel enters the bore or bores through the inlet passage when the inlet port and inlet passage align with one another, the pressure of the fuel pushing the plungers outwardly. As the distributor member rotates, the communication between the inlet port and the inlet passage is cut off, the fuel remaining in the bore or bores. Further rotation of the distributor member results in the delivery passage communicating with the outlet port and with the plungers being moved inwardly by the leading flanks of the cam lobes. The inward movement results in the fuel being pressurized and leaving the pump through the outlet port under pressure.

In order to meet emissions regulations, it is desirable to be able to vary the pumping rate for a particular speed of rotation of the distributor member.

According to the present invention there is provided a rotary pump comprising a rotary distributor member arranged, in use, to be driven in timed relationship with an associated engine, a pumping plunger mounted in a bore provided in the distributor member, first and second cam lobes positioned to impart inward pumping movement to the plunger in turn as the distributor member rotates, a delivery passage formed in the distributor member for communication with an outlet port, and means operable to select whether fuel is supplied through the delivery passage to the outlet port when the plunger is moved under the influence of the first cam lobe or the second cam lobe.

Preferably the means for selecting whether fuel is supplied through the delivery passage comprises valve means.

The distributor member preferably further comprises a first flow channel communicating with the delivery passage and a second flow channel communicating with the bore, the valve means controlling communication between the first and second flow channels.

Preferably, the pump further comprises a second pumping plunger mounted in a second bore, the distributor member further comprising a third flow channel communicating with the second bore, the valve means controlling communication between the first and third flow channels.

Preferably, the valve means comprises a muff including a passage permitting selective communication between the first and second flow channels and between the first and third flow channels. The muff is preferably angularly adjustable with respect to a body defining the inlet and outlet ports.

The first and second cam lobes preferably form part of a cam ring which is preferably provided with a further pair of cam lobes, the further cam lobes being identical to the first and second cam lobes, the pump preferably including four bores and plungers. The first cam lobe and the further cam lobe which is identical thereto are preferably diametrically opposite one another, the second cam lobe and the further lobe identical thereto also being diametrically opposite one another, the lobes preferably being equiangularly spaced around the cam ring.

The invention further relates to a rotary pump comprising a rotary distributor member arranged, in use, to be driven in timed relationship with an associated engine, a first pumping plunger reciprocable in a bore provided in the distributor member under the influence of a first cam lobe, a second pumping plunger reciprocable in a bore provided in the distributor member under the influence of a second cam lobe, a delivery passage provided in the distributor member and valve means operable to select whether fuel is supplied to the delivery passage by the first pumping plunger or by the second pumping plunger.

The invention will further be described, by way of example, with reference to the accompanying drawings, in which.

The fuel pump illustrated in FIGS. 1 to 4 is intended for use in the fuel system of a compression ignition engine for supplying fuel under pressure to the cylinders of a four cylinder four stroke engine.

Figure 1:
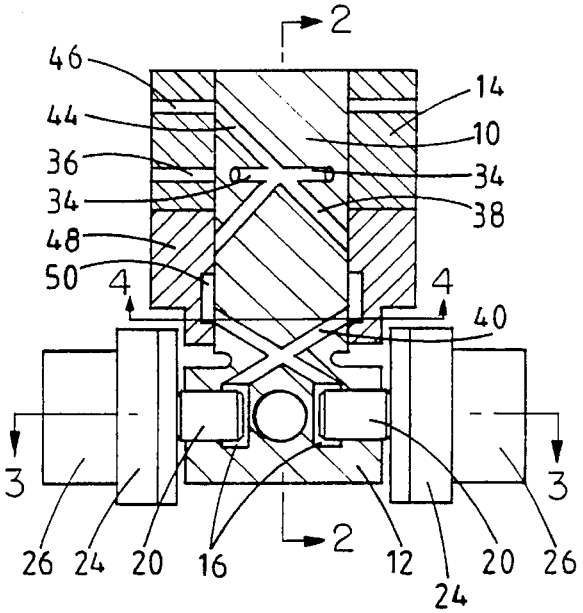
FIG. 1 is a cross sectional view of part of a fuel pump in accordance with one embodiment.
Figure 2:
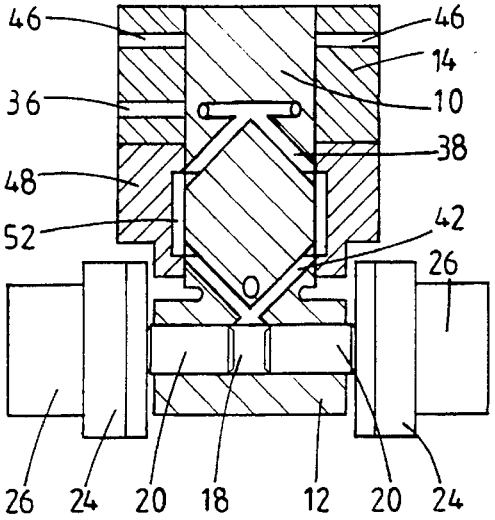
FIG. 2 is a cross sectional view along the line 2—2 of FIG. 1.
Figure 3:
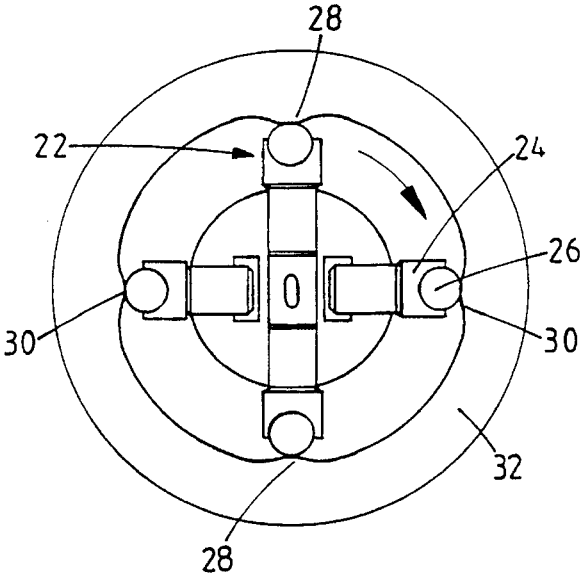
FIG. 3 is a cross sectional view along the line 3—3 of FIG. 1 also showing the cam ring of the pump.
Figure 4:
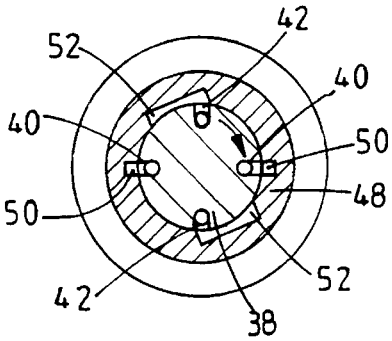
FIG. 4 is a cross sectional view along the line 4—4 of FIG. 1.

As shown in FIGS. 1 and 2, the fuel pump comprises a distributor member 10 in the form of a cylindrical member having an enlarged diameter portion 12 at an end thereof, the distributor member 10 being rotatable within a body 14. The diameter of the distributor member 10 is slightly smaller than the passage provided in the body 14 within which the distributor member 10 rotates in order to act as a seal. The enlarged portion 12 is provided with two blind bores 16 extending in a radial direction, the blind bores 16 being diametrically opposed from one another. A through bore 18 is also provided in the enlarged portion 12 (see FIG. 2), the through bore 18 also extending radially of the distributor member 10 in a direction perpendicular to the blind bores 16.

Reciprocable in the bores 16, 18 are four plungers 20, the plungers 20 being of diameter slightly smaller than the bores 16, 18 so as to permit sliding movement within the bores 16, 18 and form a seal between the walls of the bores 16, 18 and the plungers 20. The outer end of each plunger 20 is provided with a cam follower 22 comprising a shoe 24 housing a roller 26 arranged to engage the inner surface of a cam ring 32 provided with four equally spaced cam lobes 28, 30. The cam lobes 28, 30 are shaped so as to form a pair of high pumping rate lobes 28 provided opposite one another and a pair of low pumping rate lobes 30 also arranged opposite one another. It will be recognised that the arrangement of the high and low rate lobes 28, 30 is such that the force exerted on the distributor member 10 by the engagement of the cam followers 22 with the cam ring 32 is always balanced.

The distributor member 10 includes four inlet passages 34 extending inwardly from the outer wall of the distributor member 10, the passages 34 being arranged to register in turn as the distributor member 10 rotates with an inlet port 36 provided in the body 14, the inlet passages 34 communicating with one another internally of the distributor member 10. The inlet port 36 communicates with a source of fuel through a throttle arrangement (not shown) for controlling the flow of fuel to the inlet passages 34. The distributor member 10 is provided with four first flow channels 38 each of which communicates with the inlet passages 34 and terminates at an axial position intermediate the inlet port 36 and the bores 16, 18. A pair of second flow channels 40 extend from positions radially aligned with but axially spaced from the ends of two opposed first flow channels 38 and communicate with the blind bores 16, the second flow channels 40 communicating with one another. A pair of third flow channels 42 extend from positions radially aligned with but axially spaced from the ends of the other first flow channels 38 and communicate with the through bore 18.

A delivery passage 44 communicates with the inlet passages 34 and the first flow channels 38 and terminates at a position in which communication between the de livery passage 44 and one of four outlet ports 46 provided in the body 14 is permitted. The outlet ports 46 communicate, in use, with the injection nozzles of the associated engine respectively.

An angularly adjustable muff 48 surrounds the portion of the distributor member 10 including the open ends of the first, second and third flow channels 38, 40, 42, the muff 48 being mounted at an end of the body 14 and including means for restricting angular movement between the muff 48 and the body 14. The inner surface of the muff 48 is provided with a first pair of recesses 50 of relatively short axial length, as shown in FIG. 1, and a second pair of recesses 52 having an axial length great enough to permit communication between the first flow channels 38 and the second and third flow channels 40, 42, the recesses 52 being of substantial circumferential length so that communication between the flow channels 38, 40, 42 occurs during a filling period in which fuel enters the bores in communication with the inlet passages 34, and during a subsequent delivery period.

In use, the distributor member 10 of the example is driven so as to rotate at half the speed of the associated engine. In the position shown in the accompanying drawings, the delivery passage 44 is in register with one of the outlet ports 46, the plungers 20 are shown in their inner positions, the through bore 18 is in communication with the delivery passage 44 through the first and third flow channels 38, 42 and the second recesses 52 of the muff 48, the plungers 20 of the through bore 18 being under the influence of the high rate cam lobes 28, the plungers 20 of the blind bores 16 being influenced by the low rate cam lobes 30. For reasons to be explained, the delivery of pressurized fuel to that outlet port 46 has taken place from the through bore 18 only. Rotation of the distributor member 10 in the direction shown by the arrows in FIGS. 3 and 4 results in the cam followers 22 being influenced by the trailing flanks of the lobes 28, 30. These are shaped to provide an initial limited plunger retraction and as the through bore 18 only is in communication with the outlet port 46, the plungers 20 provided in the through bore 18 are moved outwardly by a limited extent due to the fuel pressure in the outlet line. Further rotation results in the communication between the delivery passage 44 and the outlet port 46 being broken and as will be seen from FIG. 4, communication between the first and third flow channels 38, 42 will also be broken, breaking the communication between the through bore 18 and the delivery passage 44.

Continued rotation of the distributor member 10 results in one of the inlet passages 34 registering with the inlet port 36, and with the first and second flow channels 38, 40 communicating with one another through the second recesses 52 of the muff 48. The rotation also results in the plunger members 20 and the associated cam followers 22 moving onto the trailing flanks of the cam lobes 28, 30. Fuel from an associated fuel tank is supplied to the inlet passage 34 by a fuel supply pump through the throttle, and due to the communication between the inlet passages 34 and the first flow channels 38, and between the first and second flow channels 38, 40, fuel is supplied to the blind bores 16, pushing the associated plungers 20 outwardly. As the third flow channels 42 are not in communication with the first flow channels 38, fuel does not enter the through bore 18 so the plungers 20 associated therewith are not pushed outwardly.

Further rotation results in the communication between the inlet passage 34 and the inlet port 36 being broken, the first and second flow channels 38, 40 remaining in communication with one another. A point will be reached at which the delivery passage 44 registers with the next outlet port 46. Very shortly after such communication is made, the followers 22 of the plungers 20 of the blind bores 16 come into contact with the leading flanks of the high rate cam lobes 28, continued rotation resulting in the plungers 20 being pushed inwardly pressurizing the fuel and delivering the pressurized fuel through the outlet port 46 to the associated cylinder of the engine. The plungers 20 of the through bore 18 were not pushed outwardly as they were not in communication with the inlet port 36 but due to the limited outward movement which takes place following the delivery of fuel, the followers 22 associated with these plungers 20 will come into contact with the low rate cam lobes 30 and will be pushed inwardly, compressing the fuel in the through bore 18. However, since this bore 18 is not in communication with the outlet port 46, the muff 48 preventing communication between the third flow channels 42 and the first flow channels 38, no fuel is pumped by these plungers 20. The inward movement of the plungers 20 compresses the fuel in the through bore 18 and the recesses 50 which communicate with the through bore 18 through the third flow channels 42 provide an additional volume for the compressed fuel. As the inward movement of these plungers was limited, the plungers 20 not having been pushed outwardly by the incoming fuel, and because of the additional volume provided by the recesses 50, the compression of the fuel is not great enough to result in a hydraulic lock.

Further rotation of the distributor member 10 will break the communication between the delivery passage 44 and the outlet port 46, and between the first and second flow channels 38, 40, and will eventually result in the first and third flow channels 38, 42 communicating with one another. The cycle then commences again but with the through bore 18 receiving and then pumping fuel to the outlet port 46, continued pumping at a particular rate alternating between the pairs of bores 16, 18 and plungers 20.

It will be recognised that only one pair of plungers 20 is used in each pumping cycle, the pumping occurring as a result of the operative plungers 20 being pushed inward due to contact between the followers 22 and the same pair of cam lobes 28, 30. In order to change pumping rate, the angular position of the muff 48 with respect to the body 14 is adjusted by 90°. Such adjustment results in pumping by the same pair of plungers for two consecutive cycles after which the alternating sequence recommences. The pumping by the same pair of plungers for two consecutive cycles results in the pumping occurring as a result of contact between the followers 22 of the plungers 20 and the second pair of cam lobes 28, 30. Thus if the pump was pumping at low rate, the adjustment of the muff by 90° results in high rate pumping. A further 90° adjustment in either the same direction or back to the original position switches back to low rate pumping.

The above described pump may be modified so as to supply fuel to a two, six or eight cylinder engine instead of the four cylinder engine mentioned. In the case of the six cylinder engine, rather than providing a through bore and a pair of blind bores in the distributor member, two sets of three bores are provided, the bores of each set being equiangularly spaced apart, the two sets being part out of alignment with one another. In this case, the cam ring is provided with three high rate cam lobes and three low rate lobes, the cam lobes being arranged in an alternating pattern. The pump may further be modified so as to have all of the bores communicating with the inlet passages during filling of the pump, only some of the bores being connected to an outlet port during delivery, the other bores being connected to a suitable volume for receiving the pressurized fuel therefrom or connected via ports to a drain, low pressure source or accumulator.

Figure 10:
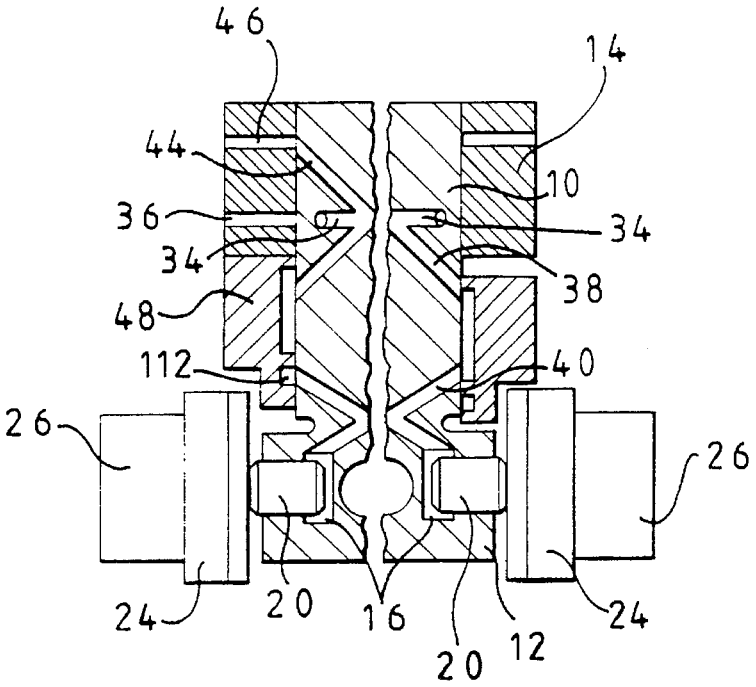
FIGS. 10 and 11 are views illustrating a modification of the pump of FIGS. 1 to 4.
Figure 11:
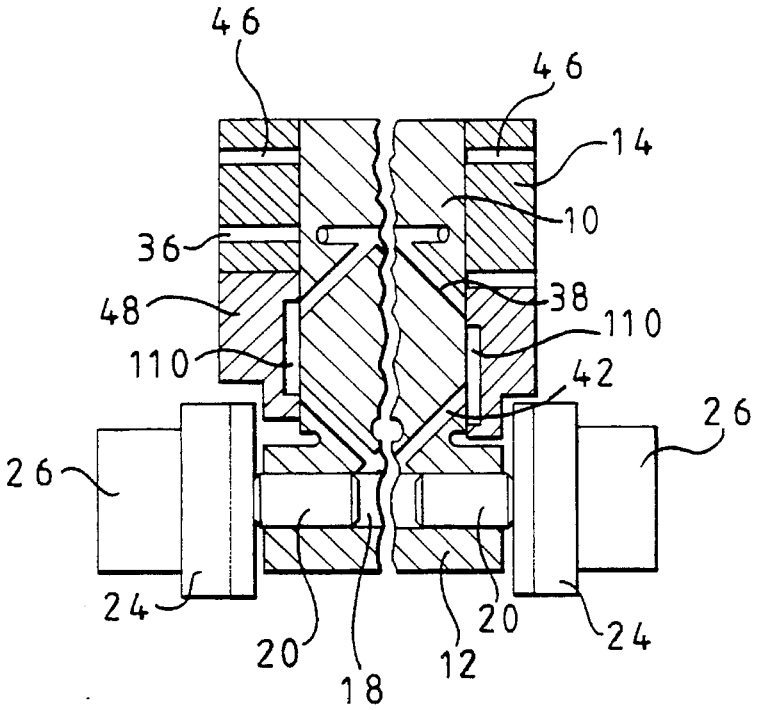

In a modification to the above described arrangement, the muff 48 is arranged to slide along the distributor member 10 rather than rotate with respect to the body 14. In this modification, as shown in FIGS. 10 and 11, when the muff 48 is in the axial position illustrated in the left half of each of FIGS. 10 and 11, a first pair of plungers communicate with the delivery passage 44 through a pair of channels 110 provided in the muff 48. The other pair of plungers communicate with respective part annular channels 112 which provide a volume similar to that provided by the recesses 52 described above.

Sliding movement of the muff 48 to the position illustrated in the right hand part of each of FIGS. 10 and 11 results in the communication between the first pair of plungers and the delivery passage 44 being broken, the channels 110 acting as the recesses 52 described above. The sliding movement of the muff 48 results in a pair of channels 114 permitting communicating between the second pair of plungers and the delivery passage 48, the part annular channels being redundant in this position.

Operation of the pump is as described above, switching between high and low rate pumping occurring by axial sliding of the muff 48, the angular position of the muff 48 with respect to the body 14 remaining fixed.

Figure 5:
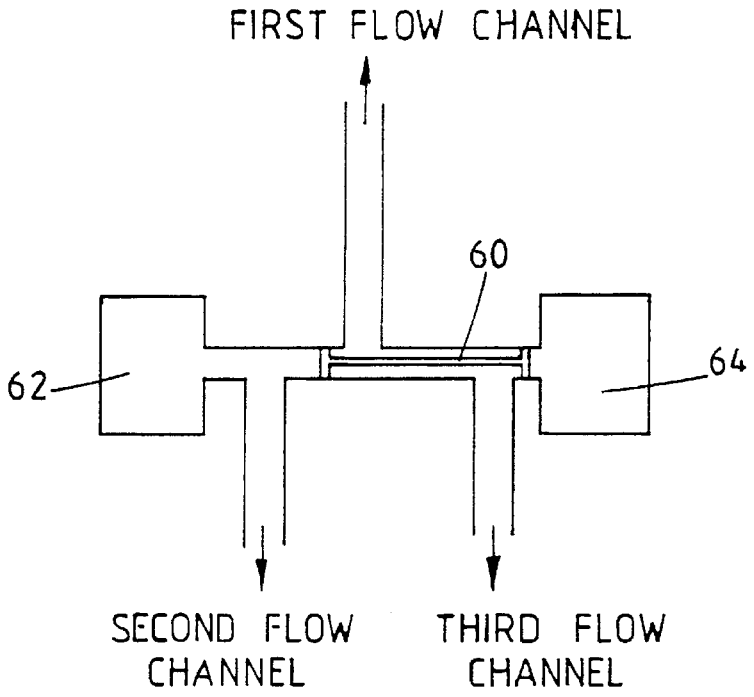
FIG. 5 is a schematic view of part of a second embodiment.

In a further alternative, the pump does not include a muff, the first, second and third flow channels terminating within the body. The body is provided with ports and passages associated with the first, second and third flow channels, and valve means controlling communication between the ports, and hence between the first, second and third flow channels. In the embodiment of FIG. 5, the valve means comprises a slidable spool valve 60 arranged to slide between a first position in which the first and third flow channels communicate with one another (as shown), the second flow channel communicating with a suitable volume, drain, or the like 62, and a second position in which the first and second flow channels communicate with one another, the third flow channel communicating with a suitable volume, drain or the like 64. Other than as described, this alternative is identical to the embodiment described and illustrated in FIGS. 1 to 4.

Operation of this device is as described above, switching between high and low rate pumping being achieved by moving the valve between its first and second positions.

Figure 6:
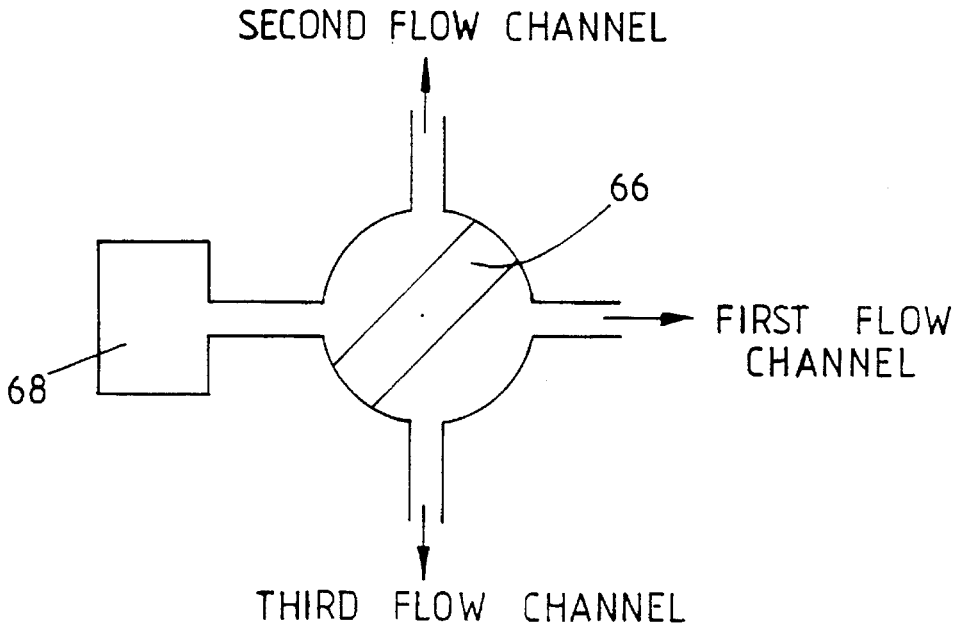
FIG. 6 is a schematic view of part of a third embodiment.

The slidable valve means may be replaced by a rotatable valve 66 as shown in FIG. 6, angular adjustment of the valve 66 switching between communication of the first and third flow channels (as shown) and communication of the first and second flow channels, the other of the second and third flow channels in each case communicating with a suitable volume, drain or the like 68.

Figure 7:
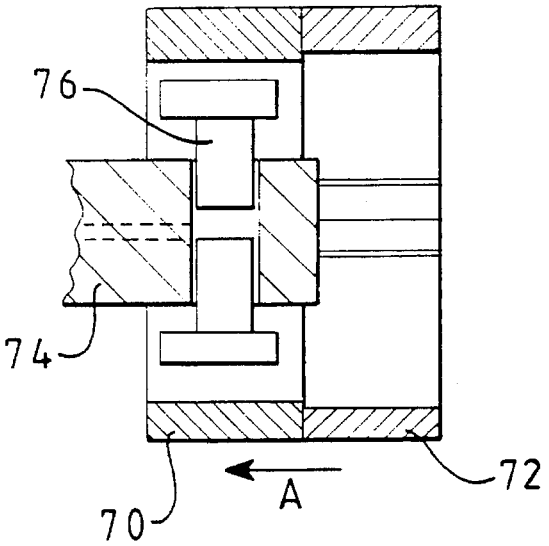
FIG. 7 is a diagrammatic view of part of another embodiment.

In a further alternative embodiment (see FIG. 7), the single cam ring is replaced by a pair of cam rings 70, 72 provided adjacent one another, one of the cam rings 70 being provided with four identical equiangularly spaced high pumping rate cam lobes, the other cam ring 72 including four identical equiangularly spaced low pumping rate cam lobes. In use, the enlarged region of the distributor member 74 rotates within the cam rings 70, 72 with the rollers and associated plungers 76 reciprocating in respective bores under the influence of the cam lobes of one of the cam rings 70, 72. In order to change pumping rate, the pair of cam rings 70, 72 are moved axially to a position in which the rollers align with the lobes of the other cam ring 70, 72. In the illustrated embodiment, this may be achieved by moving the cam rings 70, 72 in the direction of arrow A. If the rollers and plungers were originally under the influence of the high rate cam lobes, the movement results in pumping occurring under the influence of the low rate lobes.

This embodiment may be modified by arranging the distributor member to be slidable within the sleeve, the pair of cam rings being axially fixed. In order to change the pumping rate, the distributor member is moved axially with respect to the sleeve to bring the rollers into alignment with the cam lobes of the other cam ring. This arrangement is similar to that illustrated in FIG. 7.

Figure 8:
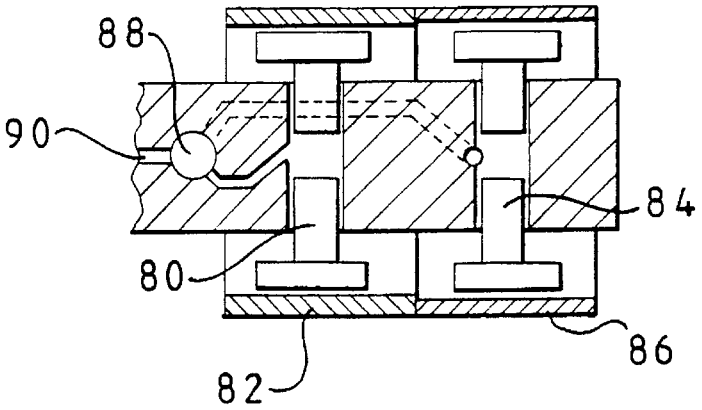
FIGS. 8 and 9 are diagrammatic views of parts of further embodiments of the invention.

A further modification (see FIG. 8) is to replace each plunger, bore, shoe and roller with a pair of sets of plungers, bores, shoes and rollers, a first set 80 aligned with a first one of the cam rings 82, the second set 84 being aligned with the second cam ring 86, the first and second sets being substantially identical to one another. The pump further includes suitable valve means 88 to connect one of the first and second bores with the inlet and delivery passage 90. In use, where pumping occurs as a result of the reciprocating movement of the first plunger, only the first bore is arranged to receive fuel from the inlet passages and deliver pumped fuel to the delivery passage 90. When it is desired to change the pumping rate, the valve means 88 is operated to connect the second bore to the inlet and delivery passage 90, and hence for pumping to occur due to the reciprocation of the second plunger under the influence of the cam lobes of the second cam ring 86.

Figure 9:
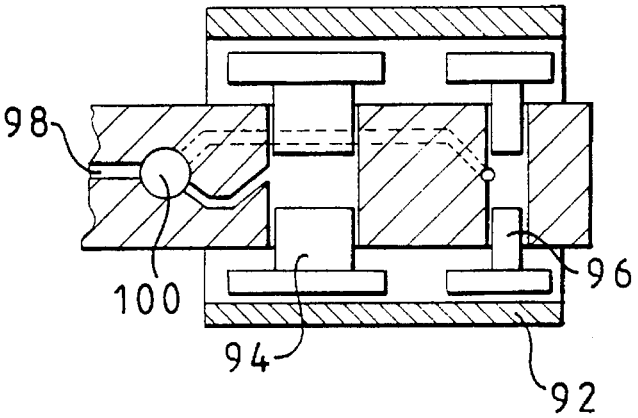

In a further embodiment (FIG. 9), the pump includes a single cam ring 92 provided with four identical cam lobes. The enlarged portion of the distributor member is provided with a first pair of opposed plungers 94 of relatively large diameter and a second pair of plungers 96 of relatively small diameter, the plungers 94, 96 being reciprocable in respective bores, each plunger being provided at its outer end with a shoe housing a roller arranged to engage with the cam ring 92 and cam lobes on rotation of the distributor member. The pump further includes an inlet passage 98 and a delivery passage arranged to communicate with associated ports provided in a sleeve within which the distributor member is rotatable. The inlet and delivery passage 98 communicates with each of the bores through a suitable valve 100 arranged so that where a low pumping rate is required, fuel is supplied to and pumped by the second plungers 96 and not the first plungers 94, and when a higher pumping rate is required, fuel is supplied to and pumped by the first plungers 94 but not the second plungers 96. It will be recognised that when the second plungers 96 are in use, the maximum fuel quantity is reduced and correction may be required in order to maintain fuel delivery levels.

Although the above description specifies that the bores not being used for pumping fuel at a particular time are not connected to and do not receive fuel, it will be recognised that these bores may be arranged to receive fuel, and to pump that fuel into a suitable volume, drain, low pressure source or accumulator during the pumping period.

In order to control the flow of fuel from the pump, the pump may take the form of a spill pump, a stroke limited pump in which outward movement of the plungers is controllable so as to control the maximum capacity of the bores, or an inlet metered pump in which a measured amount of fuel is introduced into the pump during each pumping cycle.

I claim:

1. A rotary pump comprising a rotary distributor member, a pumping plunger mounted in a bore provided in the distributor member, first and second discrete cam lobes spaced apart from one another and positioned to impart inward pumping movement to the plunger in turn as the distributor member rotates, a delivery passage formed in the distributor member for communication with an outlet port, and means operable to select whether fuel is supplied through the delivery passage to the outlet port when the plunger is moved under the influence of the first cam lobe or under the influence of the second cam lobe.

2. A pump as claimed in claim 1, wherein the means for selecting whether fuel is supplied through the delivery passage comprises valve means.

3. A pump as claimed in claim 1, wherein the first and second cam lobes form part of a cam ring which is provided with a further pair of cam lobes, the further cam lobes being identical to the first and second cam lobes.

4. A pump as claimed in claim 3, wherein the first cam lobe and the further cam lobe which is identical thereto are diametrically opposite one another, the second cam lobe and the further lobe identical thereto also being diametrically opposite one another.

5. A pump as claimed in claim 1, wherein the first and second cam lobes are provided on respective cam ring, the means for selecting comprising means for effecting relative movement of the cam rings and the distributor member.

6. A pump as claimed in claim 5, wherein the cam rings are arranged to be moved in a direction parallel to the axis of the distributor member.

7. A rotary pump comprising a rotary distributor member, a first pumping plunger reciprocable in a bore provided in the distributor member under the influence of a first cam lobe, a second pumping plunger reciprocable in a bore provided in the distributor member under the influence of a second cam lobe, a delivery passage provided in the distributor member and valve means operable to select whether fuel is supplied to the delivery passage by the first pumping plunger or by the second pumping plunger.

8. A pump as claimed in claim 7, wherein the first and second plungers are of substantially the same diameter, the first cam lobe being a relatively high fuel delivery rate lobe, the second cam lobe being a relatively low delivery rate lobe.

9. A pump as claimed in claim 7, wherein the first and second lobes are substantially identical to one another, the first plunger having a diameter greater than that of the second plunger.

10. A pump as claimed in claim 9, wherein the first and second cam lobes are integral with one another.

11. A rotary pump comprising a rotary distributor member, a pumping plunger mounted in a bore provided in the distributor member, first and second cam lobes positioned to impart inward pumping movement to the plunger in turn as the distributor member rotates, a delivery passage formed in the distributor member for communication with an outlet port, and means operable to select whether fuel is supplied through the delivery passage to the outlet port when the plunger is moved under the influence of the first cam lobe or the second cam lobe, the means for selecting whether fuel is supplied through the delivery passage being valve means, and a first flow channel provided in the distributor member and communicating with the delivery passage and a second flow channel communicating with the bore, the valve means controlling communication between the first and second flow channels.

12. A pump as claimed in claim 11 further comprising a second pumping plunger mounted in a second bore, the distributor member further comprising a third flow channel communicating with the second bore, the valve means controlling communication between the first and third flow channels.

13. A pump as claimed in claim 12, wherein the valve means comprises a muff including a passage permitting selective communication between the first and second flow channels and between the first and third flow channels.

14. A pump as claimed in claim 13, wherein the muff is angularly adjustable with respect to a body defining the outlet port.

15. A rotary pump comprising a rotary distributor member, a pumping plunger mounted in a bore provided in the distributor member, first and second cam lobes positioned to impart inward pumping movement to the plunger in turn as the distributor member rotates, a delivery passage formed in the distributor member for communication with an outlet port, and means operable to select whether fuel is supplied through the delivery passage to the outlet port when the plunger is moved under the influence of the first cam lobe or the second cam lobe, the first and second cam lobes forming part of a cam ring which is provided with a further pair of cam lobes, the further cam lobes being identical to the first and second cam lobes, and the lobes being equiangularly spaced around the cam ring.

* * * * *